US009029309B2

(12) United States Patent
Hanson et al.

(10) Patent No.: US 9,029,309 B2
(45) Date of Patent: May 12, 2015

(54) NEUTRAL FLOOR CLEANER

(75) Inventors: Catherine Hanson, Hastings, MN (US); Andrew Wold, St. Louis Park, MN (US); Traci Gioino, Maplewood, MN (US); Kim R. Smith, Woodbury, MN (US); Yvonne Marie Killeen, South St. Paul, MN (US)

(73) Assignee: Ecolab USA Inc., Saint Paul, MN (US)

( * ) Notice: Subject to any disclaimer, the term of this patent is extended or adjusted under 35 U.S.C. 154(b) by 548 days.

(21) Appl. No.: 13/399,130

(22) Filed: Feb. 17, 2012

(65) Prior Publication Data

US 2013/0213435 A1 Aug. 22, 2013

(51) Int. Cl.

| | |
|---|---|
| ***C11D 1/722*** | (2006.01) |
| ***C11D 1/825*** | (2006.01) |
| ***C11D 3/00*** | (2006.01) |
| ***C11D 3/34*** | (2006.01) |
| *C11D 1/72* | (2006.01) |

(52) U.S. Cl.
CPC *C11D 1/825* (2013.01); *C11D 1/72* (2013.01); *C11D 1/722* (2013.01); *C11D 3/0026* (2013.01); *C11D 3/0047* (2013.01); *C11D 3/3409* (2013.01)

(58) Field of Classification Search
CPC ..... C11D 1/72; C11D 1/94; C11D 1/83; C11D 11/0023
USPC ..... 510/214, 421
See application file for complete search history.

(56) References Cited

U.S. PATENT DOCUMENTS

| | | | | |
|---|---|---|---|---|
| 3,048,548 | A | 8/1962 | Martin et al. | |
| 3,334,147 | A | 8/1967 | Brunelle et al. | |
| 3,442,242 | A | 5/1969 | Laskey et al. | |
| 5,468,423 | A | 11/1995 | Garabedian, Jr. et al. | |
| 5,871,590 | A | 2/1999 | Hei et al. | |
| 5,977,048 | A | 11/1999 | Welch et al. | |
| 6,362,149 | B1 * | 3/2002 | Man et al. | 510/243 |
| 6,387,870 | B1 | 5/2002 | Klaers et al. | |
| 6,413,908 | B1 | 7/2002 | Reekmans et al. | |
| 6,425,959 | B1 * | 7/2002 | Man | 134/39 |
| 6,440,910 | B1 | 8/2002 | Smith et al. | |
| 6,462,014 | B1 | 10/2002 | Johnson et al. | |

(Continued)

FOREIGN PATENT DOCUMENTS

| | | |
|---|---|---|
| DE | 2916656 A1 | 11/1980 |
| DE | 2243307 C2 | 4/1982 |

(Continued)

OTHER PUBLICATIONS

ECOLAB USA Inc., PCT/US2013/025744, filing date Feb. 12, 2013, "The International Search Report and the Written Opinion of the International Searching Authority, or The Declaration", mailing date Jun. 2, 2013.

*Primary Examiner* — Gregory Webb
(74) *Attorney, Agent, or Firm* — McKee, Voorhees & Sease, P.L.C.

(57) ABSTRACT

Compositions and methods for improved cleaning using neutral cleaners are disclosed. In particular, neutral pH cleaning compositions according to the invention employ a synergistic combination of water insoluble surfactants and an anionic hydrotropes capable of forming a stable, low-foaming solution. The neutral cleaning solutions provide significant benefits over water insoluble microemulsions traditionally used for neutral cleaning compositions and provide at least equivalent cleaning efficacy as non-neutral cleaning compositions.

25 Claims, 2 Drawing Sheets

(56) References Cited

U.S. PATENT DOCUMENTS

| | | | | |
|---|---|---|---|---|
| 6,525,015 | B2 | 2/2003 | Man et al. | |
| 6,608,023 | B2 | 8/2003 | Klaers et al. | |
| 6,673,760 | B1 | 1/2004 | Lentsch et al. | |
| 6,716,805 | B1 | 4/2004 | Sherry et al. | |
| 6,737,553 | B1 | 5/2004 | Maas et al. | |
| 6,786,223 | B2 | 9/2004 | Klinkhammer et al. | |
| 6,881,711 | B1 | 4/2005 | Gershun et al. | |
| 6,906,230 | B1 | 6/2005 | Maas et al. | |
| 7,256,317 | B2 | 8/2007 | Maas et al. | |
| 7,530,361 | B2 | 5/2009 | Killeen et al. | |
| 2001/0031712 | A1 | 10/2001 | Ziganke et al. | |
| 2006/0105936 | A1 | 5/2006 | Shi et al. | |
| 2007/0129278 | A1* | 6/2007 | Christmas | 510/421 |
| 2008/0293612 | A1* | 11/2008 | Kellar et al. | 510/405 |
| 2012/0066839 | A1* | 3/2012 | Man et al. | 8/137 |

FOREIGN PATENT DOCUMENTS

| | | | |
|---|---|---|---|
| DE | 2301728 | C2 | 9/1982 |
| EP | 0709450 | A1 | 5/1996 |
| WO | 9618711 | A1 | 6/1996 |
| WO | 02081610 | A1 | 10/2002 |
| WO | 2004099355 | A1 | 11/2004 |

* cited by examiner

NEUTRAL FLOOR CLEANER

FIELD OF THE INVENTION

The invention relates to compositions, kits and methods for improved cleaning using neutral cleaners. In particular, neutral pH floor cleaners are disclosed using a synergistic combination of water insoluble surfactants with an anionic hydrotrope forming a stable, low-foaming solution.

BACKGROUND OF THE INVENTION

A variety of compositions are available for cleaning and/or treating hard surfaces, including architectural surfaces such as floors to reduce soil contamination. Neutral cleaning treatments continue to gain popularity among consumers wanting an environmentally responsible hard surface solution that reduces environmental impact. In addition, such neutral hard care surface solutions must provide clean, bright and shiny surfaces without increasing operational costs. It would be beneficial to provide a surface treatment composition that provides enhanced cleaning performance over current neutral cleaners, as well as meets the requirements for Green Seal compliance reflecting the low toxicity of the composition as well as eliminates the need for use of personal protective equipment by an end-user.

Accordingly, it is an objective of the claimed invention to develop neutral cleaning solutions (i.e. approximately neutral pH) while minimizing raw material costs.

A further object of the invention is to improve upon commercially-available water insoluble microemulsions for cleaning hard surfaces.

A further object of the invention is a neutral cleaning composition that provides at least equivalent cleaning efficacy as non-neutral (i.e. alkaline) cleaning compositions.

A still further object of the invention is to provide a neutral cleaning composition having a low-foaming profile.

BRIEF SUMMARY OF THE INVENTION

In an embodiment of the invention, a concentrated neutral floor treatment composition includes from about 1-50 wt-% of at least two water-insoluble surfactants, wherein a first surfactant is a branched alcohol alkoxylate and a second surfactant is an ethylene oxide/propylene oxide copolymer; and about 1-50 wt-% of a water-soluble anionic hydrotrope; and about 20-90 wt-% water, wherein the composition has a neutral pH and forms a clear solution.

In another embodiment of the invention, a concentrated neutral floor treatment composition includes about 1-10 wt-% of a water-insoluble Guerbet ethoxylate having the formula $$CH_3(CH_2)_n\underset{\underset{R^1}{|}}{C}HCH_2O(CH_2\underset{\underset{R^2}{|}}{C}HO)_mH$$

about 1-50 wt-% of a water-insoluble EO-PO copolymer; about 1-50 wt-% of a water-soluble anionic hydrotrope; and about 20-90 wt-% water, wherein the composition has a neutral pH and forms a clear solution.

Further embodiments of the invention include a kit comprising a liquid detergent composition, wherein said composition is the neutral cleaning composition; a container; and instructions for use. Kits according to the invention may also include a removal agent for use in applying the neutral cleaning compositions and removing a plurality of soils.

Additional embodiments provide for methods of cleaning a hard surface comprising: applying to the hard surface a neutral cleaning composition comprising about 1-10 wt-% a water-insoluble Guerbet ethoxylate, about 1-50 wt-% of a water-insoluble EO-PO copolymer surfactant, about 1-50 wt-% of a water-soluble anionic hydrotrope and about 20-90 wt-% of water, wherein the composition has a neutral pH and forms a clear solution. Methods according to the invention may also include a first step of diluting the composition into a use solution with water before applying the composition to a hard surface, and wherein the dilution provides a dispensing rate of a use solution of the neutral cleaning composition from about 0.1 oz./gal to about 10 oz./gal.

The methods and compositions of the invention provide at least equivalent cleaning efficacy in comparison to alkaline solutions and/or microemulsions of the water-insoluble surfactants of the invention. The equivalent cleaning efficacy to alkaline cleaning compositions provides significant benefits in the way of user safety and safety for application of the compositions to all substrates. Additional benefits of the invention include composition formulations eliminating the need for use of personal protective equipment by an end-user as a result of compliance with regulatory standards (e.g. Global Harmonized System of Classification and Labeling of Chemicals (GHS)).

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
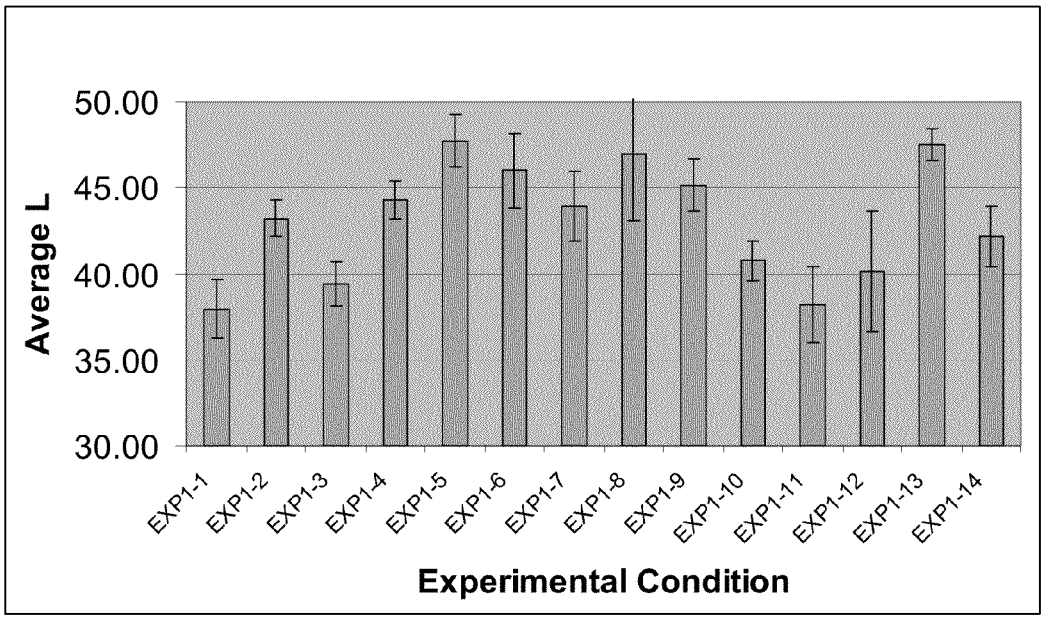
FIG. 1 shows a comparison of cleaning efficacy of neutral cleaning compositions in comparison to commercially-available controls (positive (Exp1-13) and negative controls (Exp1-10, Exp1-11, Exp1-12)).

Various embodiments of the present invention will be described in detail with reference to the drawings, wherein like reference numerals represent like parts throughout the several views. Reference to various embodiments does not limit the scope of the invention. Figures represented herein are not limitations to the various embodiments according to the invention and are presented for exemplary illustration of the invention.

DETAILED DESCRIPTION OF THE PREFERRED EMBODIMENT

The present invention relates to neutral cleaning compositions for dispensing at varying rates from about 0.1 oz./gal to about 10 oz./gal. The neutral cleaning compositions provide improved cleaning performance in comparison to commercially-available neutral cleaners. The neutral cleaning compositions, kits and methods according to the invention have many advantages over conventional neutral cleaning compositions. For example, the cleaning compositions form stable solutions, have low foaming profiles, beneficially low toxicity levels (in compliance with Green Seal criteria) and provide at least equivalent cleaning efficacy in comparison to non-neutral compositions.

The embodiments of this invention are not limited to particular neutral cleaning compositions, kits and methods of use thereof, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form. Numeric ranges recited within the specification are inclusive of the numbers defining the range and include each integer within the defined range.

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

The term "cleaning" means to perform or aid in soil removal, bleaching, microbial population reduction, rinsing, or combination thereof.

The term "hydrotrope" means a material used in a composition to maintain a single phase neat or aqueous composition or solubilisate (liquid solution). Such hydrotrope may also be used in aspects of embodiments and/or embodiments of the present invention. Hydrotropy is a property that relates to the ability of a material to improve the solubility or miscibility of a substance in liquid phases in which the substance tends to be insoluble. Without being limited to a particular theory of the invention, a hydrotrope modifies a formulation to increase the solubility of an insoluble substance or creates micellar or mixed micellar structures resulting in a stable suspension of the insoluble substance.

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

The compositions, kits and methods of the present invention may comprise, consist essentially of, or consist of the components/ingredients of the present invention as well as other components/ingredients described herein. As used herein, "consisting essentially of" means that the methods, systems, apparatuses and compositions may include additional steps, components or ingredients, but only if the additional steps, components or ingredients do not materially alter the basic and novel characteristics of the claimed methods, systems, apparatuses, and compositions.

While an understanding of the mechanism is not necessary to practice the present invention and while the present invention is not limited to any particular mechanism of action, it is contemplated that, in some embodiments, the synergistic surfactant combination of a water-insoluble Guerbet ethoxylate, a water-insoluble EO-PO copolymer, and an anionic hydrotrope provides improved neutral cleaning solutions. Without being limited to a particular mechanism of action of the synergistic combination according to the invention, in one aspect it is hypothesized that the combination of water-insoluble surfactants and anionic hydrotrope interacts to form a pseudo-ring structure that captures oily/greasy soils, providing enhanced cleaning efficacy over commercially-available neutral cleaning compositions. According to a particular theory, the double tails of the Guerbet ethoxylate may associate with the PO groups in the EO-PO copolymers, whereas the EO groups avoid this hydrophobic area and point out into the water solution.

Compositions

According to an embodiment of the invention the neutral cleaning compositions comprise, consist of and/or consist essentially of a combination of water-insoluble surfactants and an anionic hydrotrope having an approximately neutral pH. The compositions may optionally include additional functional ingredients. The compositions unexpectedly provide clear, water-soluble products providing significant utility for use as hard surface cleaners. The clear solutions are suitable for use as a dilutable detergent concentrate or as a ready-to-use product. According to the invention, a concentrate refers to a composition that is intended to be further diluted with water to provide a use composition. A use composition refers to a composition that can be applied to surfaces to provide detersive activity. In general, a use composition can have a solids content of less than about 90 wt-%, whereas the solids content refers to the weight percent of non-water components.

In an aspect of the invention the pH of the neutral cleaning composition is between about 6-9, preferably between about 6-8.5, more preferably between about 7-8. In a further aspect, the pH of the neutral cleaning composition is about 7.

The neutral cleaning compositions of water-insoluble surfactants and an anionic hydrotrope are dissolved in water to form a stable, clear solution. In general, a clear solution is a composition having a clarity similar to a composition containing only water. The compositions are distinct from detersive compositions in the prior art where combinations of water-insoluble surfactants, such as Guerbet ethoxylates (e.g. Lutensol XP-50, BASF) and/or EO-PO copolymer (Pluronic N3), form water insoluble microemulsions. These are distinct from the water soluble solutions formed by the neutral cleaning compositions of the invention. Unexpectedly, the neutral cleaning compositions uses a combination of these water-insoluble surfactants (e.g. Lutensol XP-50 and Pluronic N3) to provide a stable solution as opposed to a microemulsion. It is further unexpected to obtain the synergistic activity of the water-insoluble surfactants, which would be expected to have superior cleaning efficacy in an alkaline microemulsion of the prior art as opposed to the stable, neutral solutions of the present invention. This invention overcomes the significant difficulties associated with microemulsions, such as the narrow range of thermal phase stability. Beneficially the compositions of the invention avoid the difficulty of phase separation during storage, as a result of converting the water-insoluble surfactants into a true solution. Still further, the compositions are low-foaming, preferably non-foaming.

The compositions according to the invention may be provided in various forms for providing the detersive solution. In an aspect of the invention, the compositions are provided as a liquid. In additional aspects of the invention, the compositions are provided as a solid, gel, foam, powders, agglomerates and/or aerosol spray. In a preferred embodiment, the neutral cleaning composition is not a solid, gel, foam, or aerosol spray. The compositions may be dispensed from single or multi-use packaging in the various physical forms.

Surfactants

The neutral cleaning compositions of the invention include a combination of water-insoluble surfactants. A variety of surfactants can be used to provide synergistic detersive properties, including, but not limited to nonionic surfactants. Exemplary nonionic surfactants that can be used are commercially available from a number of sources. A discussion of surfactants is provided in Kirk-Othmer, Encyclopedia of Chemical Technology, Third Edition, volume 8, pages 900-912, incorporated herein by reference.

In an aspect of the invention, the compositions include a synergistic combination of water-insoluble surfactants. In an further aspect, the compositions include synergistic combination of nonionic, water-insoluble surfactants. In an aspect of the invention, the synergistic combination of water-insoluble surfactants includes a branched alcohol alkoxylate (e.g. Guerbet ethoxylate) and an EO-PO copolymer. In a further aspect, the water-insoluble EO-PO copolymer may be a traditional EO-PO copolymer, a reverse EO-PO copolymer, and/or combinations of the same.

Branched Alcohol Alkoxylates

Particularly suitable water-insoluble surfactants include branched alcohol alkoxylates. Further description of these surfactants is found in U.S. Pat. No. 7,530,361 titled "Detergent Composition Containing Branched Alcohol Alkoxylate and Compatibilizing Surfactant, and Method for Using," which is herein incorporated by reference in its entirety. Preferred branched alcohol alkoxylates include Guerbet ethoxylates. Guerbet ethoxylates suitable for use according to the invention have the following formula:

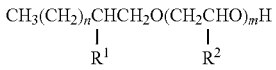

In an aspect of the invention the Guerbet ethoxylate is further defined wherein R1 is C2-C20 alkyl and R2 is H or C1-C4 alkyl. In a further aspect of the invention, the Guerbet ethoxylate is defined wherein "n" is an integer between 2 and 20 and wherein "m" is an integer between 1 and 40.

In a preferred aspect of the invention, the branched alcohol alkoxylate is a Guerbet ethoxylate that is prepared from a Guerbet alcohol by dimerization of alkenes (e.g. butane).

The branched alcohol alkoxylates, including Guerbet ethoxylates, can be prepared according to U.S. Pat. Nos. 6,906,320, 6,737,553 and 5,977,048, the disclosure of these patents are herein incorporated by reference in their entirety. Exemplary branched alcohol alkoxylates include those available under the tradenames Lutensol XP-30 and Lutensol XP-50 (BASF Corporation). In general, Lutensol XP-30 can be considered to have 3 repeating ethoxy groups, and Lutensol XP-50 can be considered to have 5 repeating ethoxy groups.

Branched alcohol alkoxylates can be classified as relatively water insoluble or relatively water soluble. In general, a water insoluble branched alcohol alkoxylate can be considered an alkoxylate that, when provided as a composition containing 5 wt-% of the branched alcohol alkoxylate and 95 wt-% water, has a tendency to deposit on a surface and form a greasy film. Lutensol XP-30 and Lutensol XP-50 from BASF Corporation are examples of water-insoluble branched alcohol alkoxylates.

According to an embodiment of the invention a branched alcohol alkoxylate, preferably a water-insoluble Guerbet ethoxylate has from about 10 wt-% to about 90 wt-% ethylene oxide, from about 20 wt-% to about 70 wt-% ethylene oxide preferably from about 30 wt-% to about 60 wt-% ethylene oxide.

According to an embodiment of the invention, composition materials and levels thereof are present in concentrate compositions (and thereafter a use solution) and comply with regulatory standards (e.g. GHS) for no requirement of using personal protective equipment such as gloves and goggles by an end-user. In a further aspect of the invention, the composition complies with the requirements set forth in the GS37 standard for environmentally-friendly and safe hard surface cleaners. In a still further aspect of the invention, the composition meets GHS standards for no requirement of personal protective equipment use such as gloves and goggles by an end-user.

Ethylene Oxide-Propylene Oxide Copolymers

Particularly suitable water-insoluble surfactants include nonionic surfactants. Exemplary surfactants include, but are not limited to, those having a polyalkylene oxide polymer as a portion of the surfactant molecule. Such nonionic surfactants include, but are not limited to: chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated amines such as alkoxylated ethylene diamine; alcohol alkoxylates such as alcohol ethoxylate propoxylates, alcohol propoxylates, alcohol propoxylate ethoxylate propoxylates, alcohol ethoxylate butoxylates; nonylphenol ethoxylate, polyoxyethylene glycol ether; carboxylic acid esters such as glycerol esters, polyoxyethylene esters, ethoxylated and glycol esters of fatty acids; carboxylic amides such as diethanolamine condensates, monoalkanolamine condensates, polyoxyethylene fatty acid amides; and polyalkylene oxide block copolymers.

Examples of particularly suitable water-insoluble, nonionic surfactants include ethylene oxide/propylene oxide block copolymer. Ethylene oxide/propylene oxide block copolymers as disclosed herein also include reverse ethylene oxide/propylene oxide copolymers. A combination of various traditional and/or reverse ethylene oxide/propylene oxide copolymers may also be employed in the neutral cleaning compositions of the invention. In a preferred aspect of the invention, the ethylene oxide/propylene oxide block copolymer is a reverse EO-PO copolymer. In a further preferred aspect of the invention, the ethylene oxide/propylene oxide block copolymer has a molecular weight less than about 10,000. Still further, in a preferred aspect of the invention, the ethylene oxide/propylene oxide block copolymer has water solubility less than about 1%. Commercially-available ethylene oxide/propylene oxide block copolymers include but are not limited to, PLURONIC® products (BASF Corporation).

The water-insoluble surfactants are included in the neutral cleaning compositions in an amount effective to provide the detersive properties for effective cleaning. An effective amount should be considered as an amount that provides a concentrate of the neutral cleaning composition the optional detersive property. In an aspect the water insoluble surfactants are provided in the amounts of from about 1 wt-% to about 60 wt-%, preferably from about 5 wt-% to about 40 wt-%.

In a further aspect of the invention the water-insoluble Guerbet ethoxylate surfactant is provided in the amounts of from about 1 wt-% to about 10 wt-%, from about 1 wt-% to about 8 wt-%, preferably from about 1 wt-% to about 5 wt-%.

In a further aspect the water-insoluble EO-PO copolymer surfactant is provided in the amounts of from about 1 wt-% to about 50 wt-%, from about 1 wt-% to about 40 wt-%, preferably from about 5 wt-% to about 20 wt-%.

Hydrotropes

In an aspect of the invention and without being limited to a particular theory of the invention, the anionic hydrotrope is combined with the water-insoluble surfactants to form a clear solution having stability at high temperatures. According to an aspect of the invention the hydrotrope provides clear stability at temperatures up to about 50° C. and above. The combination is counterintuitive to one of skill in the art as the addition of the water soluble anionic hydrotrope is detrimental to the detersive microemulsions of the prior art. The combination of the anionic hydrotrope forms a mixed micelle system resulting in a clear solution, destroying the micro-emulsion created by the combination of water-insoluble surfactants according to the invention.

Hydrotrope usable according to aspects of embodiments of the invention include aromatic sulfonic acid, sulfonated hydrotropes such as C1-C5 substituted benzene sulfonic acid, naphthalene sulfonic acid, and the like, or combinations thereof. Examples of such a hydrotrope are xylene sulfonic acid, toluene sulfonic acid, naphthalene sulfonic acid, salts of xylene sulfonic acid (e.g., xylene sulfonic acid, sodium salt; xylene sulfonic acid, ammonium salt; xylene sulfonic acid, calcium salt; and/or xylene sulfonic acid, potassium salt; cumene sulfonic acid, sodium salt; and/or cumene sulfonic acid, ammonium salt), salts of toluene sulfonic acid (e.g., toluene sulfonic acid, sodium salt; and/or toluene sulfonic acid, potassium salt), salts of naphthalene sulfonic acid, and the like, or combinations thereof.

According to the invention, particularly suitable anionic hydrotropes are low molecular weight, water soluble agents. In a further aspect, suitable anionic hydrotropes include low molecular weight carboxylates, optionally sulfonates. According to a preferred aspect of the invention, the anionic hydrotrope is selected from the group consisting of xylene sulfonate and its salts, cumene sulfonate and its salts, and a C6-C10 fatty acid and its salts.

A number of commercially available hydrotropes may be suitable for use in aspects of embodiments and/or embodiments of the present invention. Commercially available hydrotropes may be obtained from a variety of vendors including, but not limited to, products under the tradename NAXONATE®. Additional examples of commercially-available anionic hydrotropes include sodium xylene sulfonate (SXS) and Colatrope INC, each of which are available from multiple sources.

The anionic hydrotrope is included in the neutral cleaning compositions in an amount effective to provide the stable, clear solution to overcome the water-insolubility of the combination of surfactants according to the invention. In general, a clear solution is a composition having a clarity (e.g. absence of haze) similar to a composition containing only water. A clear aqueous composition further refers to a composition that is substantially free of haze. By substantially free of haze, it is meant that one would not perceive the composition as hazy by simply viewing a 100 gram sample of the aqueous composition.

According to the invention, an effective amount of the anionic hydrotrope should be considered as an amount that provides a concentrate of the neutral cleaning composition the optimal solution stability while maintaining a clear solution. In an aspect of the invention the compositions retains phase stability at elevated temperatures, in particular at temperatures up to about 40° C., preferably up to about 50° C., and more preferably up to about 60° C. In an aspect the water soluble anionic hydrotrope is provided in the amounts (weight percent) of from about 1 wt-% to about 50 wt-%, from about 1 wt-% to about 40 wt-%, preferably from about 5 wt-% to about 20 wt-%. As one of skill in the art will ascertain various suitable water soluble anionic hydrotropes are commercially-available in formulations having variable active levels which significantly impact the wt-% in the compositions according to the invention (e.g. SXS commercially available as 96% in powder form, 40% in solution, etc.).

In an aspect of the invention the weight ratio of the water-insoluble EO-PO copolymer surfactant to water-insoluble Guerbet ethoxylate surfactant is between about 2:1 to 20:1, preferably from about 2:1 to 10:1. In a preferred aspect the weight ratio of the water-insoluble EO-PO copolymer surfactant to water-insoluble Guerbet ethoxylate surfactant is between about 4:1 to 7:1.

In a further aspect the weight ratio of the water-insoluble Guerbet ethoxylate surfactant to the anionic hydrotrope is between about 1:20 to 5:1, preferably from about 1:10 to 2:1, and more preferably from about 1:10 to 1:1. In a preferred aspect the weight ratio of the water-insoluble Guerbet ethoxylate surfactant to the anionic hydrotrope is between about 1:6 to 1:1.

Still further the weight ratio of the water-insoluble EO-PO copolymer surfactant to the anionic hydrotrope is between about 1:10 to 10:1, preferably from about 1:5 to 5:1, more preferably about 1:3 to 3:1. In a preferred aspect the weight ratio of the water-insoluble EO-PO copolymer surfactant to the anionic hydrotrope is between about 1:1 to 3:1.

In a further aspect of the invention the components of the composition may be provided on an actives level (without water in the composition). As one of ordinary skill in the art will ascertain suitable amounts of water can be added to such compositions based on an actives level. In such an aspect of the invention the weight ratio of the water-insoluble EO-PO copolymer surfactant to water-insoluble Guerbet ethoxylate surfactant on an actives level is between about 2:1 to 20:1, preferably from about 2:1 to 10:1, and most preferably from about 4:1 to 7:1. In another aspect, the weight ratio of the water-insoluble Guerbet ethoxylate surfactant to the anionic hydrotrope on an actives level is between about 1:10 to 1:1, preferably from about 1:5 to 1:1, and more preferably from about 1:3 to 1:1. In another aspect, the weight ratio of the water-insoluble EO-PO copolymer surfactant to the anionic hydrotrope on an actives level is between about 1:5 to 5:1, preferably from about 1:3 to 3:1, and most preferably from about 1:1 to 3:1.

Optional Functional Ingredients

According to an optional embodiment of the invention, additional functional ingredients may be added to the neutral cleaning compositions of the invention. The compositions may include additional components or agents, referred to herein as additional functional ingredients. For the purpose of this application, the term "functional ingredients" includes a material that when dispersed or dissolved in a use and/or concentrate solution, such as an aqueous solution, provides a beneficial property in a particular use.

In an aspect of the invention, the compositions may further comprise, consist of and/or consist essentially of a preservative, colorant, fragrance, viscosity modifier, organic solvent, antimicrobial agent, alkalinity source, chelating agents, pH adjusters/buffers, foam modifiers, pearlising agents, stabilizing agents, rheology modifiers and/or combinations thereof.

In an aspect of the invention, no additional functional ingredients are added to the neutral cleaning composition. In a further aspect of the invention, no defoaming agent is added as a result of the low-foaming profile of the neutral cleaning composition. In a further embodiment of the invention, no viscosity modifier is included. In a still further embodiment of the invention, no builder, chelant, sequestrant and/or threshold agent or inhibitor is included. Still further, in another embodiment, the neutral cleaning composition does not contain an organic solvent.

Optional functional ingredients may be included in the neutral cleaning compositions in an amount effective to provide the optional functional properties. An effective amount should be considered as an amount that provides a concentrate of the neutral cleaning composition the optional functional property. In an aspect the optional functional ingredient(s) are provided in the amounts of from about 0.1 wt-% to about 50 wt-%, preferably from about 0.1 wt-% to about 20 wt-%.

Water

Water can be added to the detersive neutral cleaning composition concentrate to form the detergent composition use composition. In general, the use composition refers to the composition that contacts a surface or article to provide detersive activity. It can be advantageous to distribute the neutral cleaning composition in the form of a concentrate, and then dilute the concentrate with water to provide a use composition at the situs of use. According to the invention water can be added to the concentrate to provide a use composition having a dispense rate of from about 0.1 oz./gal to about 10 oz./gal, preferably from about 0.1 oz./gal to about 6 oz./gal, more preferably from about 0.1 oz./gal to 4 oz./gal.

The neutral cleaning composition concentrate can be provided without water or it can be provided in a form that contains water. The concentrate can be provided as a powder, a solid, a gel, or a liquid. When the concentrate is provided in the form of a powder, the concentrate can contain about 0 to about 10 wt-% water, about 0.1 wt-% to about 10 wt-% water, or about 0.2 wt-% to about 5 wt-% water. When the concentrate is provided in the form of a solid, the concentrate can contain about 0 to about 50 wt-% water, about 5 wt-% to about 30 wt-% water, or about 10 to about 25 wt-% water. When the concentrate is provided as a liquid, the concentrate can contain about 20 wt-% to about 90 wt-% water or about 25 wt-% to about 80 wt-% water. In general, the concentrate can contain water in an amount of less than about 90 wt-%. Above 90 wt-% water, the neutral cleaning composition tends to look more like a use composition. It should be understood, however, that the weight percent solids in the use composition can be adjusted to provide a desired level of detersive activity. In certain circumstances, it may be desirable to provide a use composition having a solids content that is less than about 5 wt-%, less than about 3 wt-%, less than about 1 wt-%, less than about 0.5 wt-%, or less than about 0.1 wt-%.

Kits

According to a further embodiment of the invention, the neutral cleaning compositions of the invention can be packaged and provided as a kit for hard surface cleaning. According to an embodiment of the invention, a kit may comprise, consist of and/or consist essentially of the neutral cleaning composition according to the invention, a container, and suitable instructions for use. According to a further embodiment, the kit may also include a removal agent for removing a plurality of soils from a treated hard surface.

Suitable removal agents for use in applying the cleaning compositions for removing a plurality of soils according to the invention include but are not limited to: a scrubber, a mop, a roller or a spray. Examples of suitable scrubbers include manual and auto floor scrubbers. Examples of suitable mops include string and flat mops.

Methods of Use

An embodiment of the invention includes a method of using the neutral cleaning compositions to clean hard surfaces, particularly architectural surfaces, particularly floors. The methods of use are suitable for both indoor and outdoor applications. The methods of use of the neutral cleaning compositions may be employed on a daily or weekly basis for cleaning. In a further aspect the methods of use of neutral cleaning compositions may be employed on a less frequent basis. In one embodiment, the composition is applied onto a surface at least about 3 days a week. In an alternative embodiment, the composition is applied onto a surface once a day. One of ordinary skill in the art will ascertain the various application timings according to the invention.

The methods of cleaning a surface may comprise, consist essentially of or consist of applying the neutral cleaning composition to a hard surface, and allowing the hard surface to dry. A surface treated with the composition generally dries within about 1 hour of when the composition is applied to the surface. However, the amount of time it takes a surface coated with the composition to dry depends on the method used to apply the composition and the environmental conditions. A surface treated with the composition may dry within about 30 minutes, about 15 minutes, about 5 minutes and about 1 minute of when the composition is applied to the surface. For example, if the composition is applied with a mop and bucket, the surface will dry within about 5 to 15 minutes. If the composition is applied with an auto scrubber, the surface will dry almost immediately.

According to a further embodiment, the method comprises, consists essentially of or consists of applying to a hard surface a neutral cleaning composition comprising about 1-10 wt-% a water-insoluble Guerbet ethoxylate surfactant, about 1-50 wt-% of a water-insoluble EO-PO copolymer surfactant, about 1-50 wt-% of a water-soluble anionic hydrotrope and about 20-90 wt-% of water, wherein the composition has a neutral pH and forms a clear solution. The methods may include a step of first diluting the composition into a use solution with water before applying the composition to a hard surface, and wherein the dilution provides a dispensing rate of a use solution of the neutral cleaning composition from about 0.1 oz./gal to about 10 oz./gal, preferably from about 0.1 oz./gal to about 6 oz./gal, more preferably from about 0.1 oz./gal to 4 oz./gal.

The neutral cleaning compositions according to the invention may be applied to a hard surface using a variety of well-known application techniques. Suitable and non-limiting methods of application include mop and bucket, auto scrubber, flat mop, string mop, spray dispenser or other conventional application methods. A surface to be treated according to the invention may be further treated using additional cleaning agents, rinse agents and/or polish agents or solvents that will be familiar to those skilled in the art.

The methods may optionally include a rinsing step to remove any excess neutral cleaning composition. A rinse step may be used alone or in combination with a further step for removing soils from the hard surface, e.g. applying a water source and/or mechanical force to remove soils. For example, the use of non-traditional mechanical force, such as compressed air or a vacuum can be utilized to clean the treated hard surface in combination with the neutral cleaning compositions.

Additional treatment steps may be employed in combination with the invention. Without being limited to a particular combination of surface treatments suitable for combined use with the neutral cleaning compositions, exemplary treatments include application of compositions for additional shine, non-slip, polish, polish restoration or the like.

The methods of use according to the invention are suitable for cleaning or treating a variety of hard surfaces, particularly architectural surfaces, particularly floors. Suitable substrate materials often used for flooring including marble, granite, other stone surfaces, terrazzo, concrete, dry shake, ceramic tiles, wood, laminate, linoleum, vinyl, cork, bamboo and rubber substrates. Flooring surfaces described herein are understood to include both coated and uncoated floor surfaces, and further porous or non-porous floors.

Additional suitable hard surfaces for application of the neutral cleaning compositions according to the invention include a variety of soiled surfaces. Exemplary soiled surfaces include architectural hard surfaces, such as toilet bowls, baths, showers, other plumbing fixtures, bathroom and kitchen hard surfaces (e.g., countertops), glass windows, and vehicular surfaces. One of ordinary skill in the art will ascertain from the disclosure of the invention the various suitable hard surfaces that would benefit from the methods and compositions of the present invention.

All publications and patent applications in this specification are indicative of the level of ordinary skill in the art to which this invention pertains. All publications and patent applications are herein incorporated by reference to the same extent as if each individual publication or patent application was specifically and individually indicated as incorporated by reference.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

Various materials are used in the following, non-limiting examples. Additional description of these materials and preferred ranges and ratios of the components for concentrated compositions according to the invention are provided below in Tables 1A-1C.

TABLE 1A

| Material | Tradename | Description | Vendor |
|---|---|---|---|
| Water-Insoluble Surfactant (Guerbet ethoxylate) | Lutensol XP-50 | Ethoxylated 1-hydroxy-2-propyl-heptane | BASF Corp. |
| Water-Insoluble Surfactant | Tergitol 15-F-7 | secondary alcohol ethoxylate nonionic | DOW |
| Water-Insoluble Copolymer Surfactant | Pluronic L61 | Ethylene Oxide/Propylene Oxide Block Copolymer | BASF Corp. |
| Water-Insoluble Copolymer Surfactant | Pluronic N3 | reverse (i.e. PO-terminated) ethylene oxide-propylene oxide copolymer surfactant | BASF Corp. |
| Hydrotrope | Sodium Xylene Sulfonate (SXS) | sodium salt of ring sulfonated mixed xylene isomers | Various |
| Hydrotrope | Colatrope INC | Isononanoic Acid, sodium salt (1:1) | Colonial Chemical |
| Preservative | Kathon | Chloro Methyl Isothiazolin mixture | Various |

TABLE 1B

| Component | Range 1 (wt %) | Range 2 (wt %) | Range 3 (wt %) |
|---|---|---|---|
| Water-Insoluble Surfactant | 1-10 wt-% | 1-8 wt-% | 1-5 wt-% |
| Water-Insoluble Copolymer Surfactant | 1-50 wt-% | 1-40 wt-% | 5-20 wt-% |
| Hydrotrope | 1-50 wt-% | 1-40 wt-% | 5-20 wt-% |
| Water | 20-90 wt-% | 30-90 wt-% | 50-90 wt-% |
| Other Ingredients | 0.1-50 wt-% | 0.1-20 wt-% | 0.1-10 wt-% |

TABLE 1C

| % by wt Components Ratio | | | |
|---|---|---|---|
| Water-Insoluble Copolymer Surfactant (EO-PO polymer) to Water-Insoluble Surfactant (Guerbet) | 2:1-20:1 | 2:1-10:1 | 4:1-7:1 |
| Water-Insoluble Surfactant (Guerbet) to Hydrotrope | 1:20-5:1 | 1:10-2:1 | 1:10-1:1 |
| Water-Insoluble Copolymer Surfactant (EO-PO polymer) to Hydrotrope | 1:10-10:1 | 1:5-5:1 | 1:3-3:1 |
| **Active Components Ratio** | | | |
| Water-Insoluble Copolymer Surfactant (EO-PO polymer) to Water-Insoluble Surfactant (Guerbet) | 2:1-20:1 | 2:1-10:1 | 4:1-7:1 |
| Water-Insoluble Surfactant (Guerbet) to Hydrotrope | 1:10-1:1 | 1:5-1:1 | 1:3-1:1 |
| Water-Insoluble Copolymer Surfactant (EO-PO polymer) to Hydrotrope | 1:5-5:1 | 1:3-3:1 | 1:1-3:1 |

Example 1

Neutral cleaning compositions according to the invention were formulated to achieve a low foam formulation, and comply with low toxicity requirements (e.g. GS37 Standard and/or Green Seal compliant). The compositions were concentrated at an appropriate level to provide acceptable cleaning at a 0.25 oz/gal dispense rate. The neutral cleaning compositions were compared to various cleaning compositions that are commercially-available.

Commercial Product A is a commercially-available, daily use neutral floor-cleaning composition, providing a negative control for various cleaning experiments. Commercial Product A has a recommended cleaning concentration of 0.5 oz/gal-1.0 oz/gal. Commercial Product B is a commercially-available, daily use neutral floor cleaner with a daily use recommended cleaning concentration of 0.64 oz/gal or 0.50%. Commercial Product C is a competitive, daily use neutral floor cleaner with a daily use recommended cleaning concentration of 0.25 oz/gal-0.5 oz/gal. Commercial Product D is a commercially-available, daily use, alkaline floor-cleaning composition with a daily use recommended cleaning concentration of 0.25 oz./gal. This product is not a neutral composition, providing a positive control for various cleaning experiments and was tested at a 0.5 oz./gal cleaning concentration to further test the cleaning efficacy of the neutral cleaning compositions of the invention.

The cleaning ability of the various neutral cleaning compositions at the maximum allowable concentrations, complying with the toxicity limitations was evaluated. The toxicity limitations apply to the concentrated product. The maximum active level of the concentrate was first calculated. From there, the use active level was calculated based on a 0.25 oz/gal dilution. Concentrates were prepared at a 19% active level so the dilution level of the concentrates was adjusted to provide the desired use solution active levels. Table 2 shows the maximum concentrate active level (%) allowed for compliance of toxicity limitations set forth in the GS37 Standard.

TABLE 2

| Concentrate ID | Maximum Concentrate Active Level (%) Allowable for Toxicity Limitations | Use Dilution Active Level w/0.25 oz/gal Dilution (%) | Use Dilution Active Level w/0.25 oz/gal Dilution (ppm) |
|---|---|---|---|
| C1 | 16% | 3.13% | 313 |
| C2 | 21% | 4.10% | 410 |
| C3 | 29% | 5.66% | 566 |
| C4 | 16% | 3.13% | 313 |
| C5 | 21% | 4.10% | 410 |
| C6 | 29% | 5.66% | 566 |
| C7 | 16% | 3.13% | 313 |
| C8 | 21% | 4.10% | 410 |
| C9 | 8% | 1.56% | 156 |

Table 3 shows various concentrate formulations according to the invention. Table 4 shows the various use solution preparations according to the invention.

TABLE 3

| Raw Material | expressed in % by wt | | | | | | | |
|---|---|---|---|---|---|---|---|---|
| Description | C1 | C2 | C3 | C4 | C5 | C6 | C7 | C8 |
| Water | 81.02 | 81.00 | 81.00 | 81.00 | 81.00 | 81.00 | 81.00 | 81.00 |
| Lutensol XP50 | 6.02 | 4.00 | 2.00 | 6.00 | 4.00 | 2.00 | 6.00 | 4.00 |
| Tergitol 15-F-7 | 12.96 | 15.00 | 17.00 | 0.00 | 0.00 | 0.00 | 0.00 | 0.00 |
| Pluronic N3 | 0.00 | 0.00 | 0.00 | 13.00 | 15.00 | 17.00 | 0.00 | 0.00 |
| Pluronic L61 | 0.00 | 0.00 | 0.00 | 0.00 | 0.00 | 0.00 | 13.00 | 15.00 |
| Desired Use Active Level | 3.13% | 4.10% | 5.66% | 3.13% | 4.10% | 5.66% | 3.13% | 4.10% |
| Dilution Level | 0.16% | 0.22% | 0.30% | 0.16% | 0.22% | 0.30% | 0.16% | 0.22% |

TABLE 4

| Experimental Test ID | Concentrate ID | g Concentrate | g Water | % by wt. conc |
|---|---|---|---|---|
| EXP1-1 | C1 | 0.81 | 499.21 | 0.16% |
| EXP1-2 | C2 | 1.11 | 498.94 | 0.22% |
| EXP1-3 | C3 | 1.50 | 499.74 | 0.30% |
| EXP1-4 | C4 | 0.80 | 499.21 | 0.16% |
| EXP1-5 | C5 | 1.15 | 498.85 | 0.23% |
| EXP1-6 | C6 | 1.55 | 498.44 | 0.31% |
| EXP1-7 | C7 | 0.79 | 499.20 | 0.16% |
| EXP1-8 | C8 | 1.10 | 498.92 | 0.22% |
| EXP1-9 | C9 | 0.35 | 499.64 | 0.07% |
| EXP1-10 | Commercial Product A | 1.96 | 499.20 | 0.39% |
| EXP1-11 | Commercial Product B | 0.99 | 502.63 | 0.20% |
| EXP1-12 | Commercial Product C | 1.00 | 499.00 | 0.20% |
| EXP1-13 | Commercial Product D | 1.95 | 498.34 | 0.39% |
| EXP1-14 | Water | 0.00 | 500.00 | 0.00% |

Example 2

The neutral cleaning compositions according to the invention and the Commercial Products according to Example 1 were evaluated for soil cleaning efficacy.

Soil Application Procedure: Black oily soil was made by mixing the approximate amounts of the following materials: 50 g Mineral Spirits, 5 g Mineral Oil, 5 g 10/30 W Motor Oil, 2.5 g Oil Dag, and 37.5 g Bandy Black Clay.

Cleaning Procedure: Four coupons were cleaned per condition tested, using 5-grain tap water as a control. The coupons were placed in the tray and ~200 g of the cleaner/dilution was added. The coupons were allowed to sit in solution 2 minutes before cleaning. After adequate dwell time, a sponge was placed in the PFA, and cleaning begun. The normal force before each cycle was set to 2 lbs. The black soiled coupons underwent four sets of 10 cycles (20 passes×4 sets) each. Two coupons were tested per PFA run.

Data Analysis Procedure: After soiling, 10 measurements of the L, a, and b values of the coupons were taken at random. After cleaning, 5 measurements of L, a, and b were taken per coupon, and the averaged values as well as their standard deviation were considered. After soiling the coupons, they had a very similar color values. One set of five coupons had an L value of 27.92+/−0.49 and a second set of five coupons had an L value of 28.05+/−0.29. The after clean color data is below in Table 5 (After Clean Color Data) and further depicted in FIG. 1.

TABLE 5

| Cleaner | L | St. Dev | a | St. Dev | b | St. Dev | Avg L | St. Dev |
|---|---|---|---|---|---|---|---|---|
| EXP1-1 | 38.19 | 0.65 | 0.32 | 0.09 | 1.72 | 0.10 | | |
| EXP1-1 | 40.21 | 1.56 | 0.25 | 0.03 | 1.85 | 0.16 | | |
| EXP1-1 | 37.19 | 1.01 | 0.29 | 0.04 | 1.67 | 0.19 | | |
| EXP1-1 | 36.24 | 1.65 | 0.23 | 0.06 | 1.14 | 0.18 | 37.96 | 1.70 |
| EXP1-2 | 43.98 | 1.32 | 0.31 | 0.04 | 2.02 | 0.18 | | |
| EXP1-2 | 43.07 | 1.67 | 0.32 | 0.04 | 1.97 | 0.16 | | |
| EXP1-2 | 42.23 | 1.12 | 0.39 | 0.06 | 2.03 | 0.30 | | |
| EXP1-2 | 44.34 | 0.74 | 0.48 | 0.05 | 2.72 | 0.06 | 43.21 | 1.06 |
| EXP1-3 | 37.72 | 0.69 | 0.30 | 0.04 | 1.41 | 0.04 | | |
| EXP1-3 | 39.06 | 1.07 | 0.32 | 0.08 | 1.83 | 0.22 | | |
| EXP1-3 | 40.09 | 1.40 | 0.47 | 0.05 | 2.27 | 0.20 | | |
| EXP1-3 | 40.75 | 0.93 | 0.27 | 0.03 | 1.59 | 0.11 | 39.41 | 1.32 |
| EXP1-4 | 43.08 | 1.33 | 0.28 | 0.01 | 1.58 | 0.10 | | |
| EXP1-4 | 45.77 | 1.41 | 0.35 | 0.07 | 2.02 | 0.26 | | |
| EXP1-4 | 44.42 | 0.76 | 0.36 | 0.03 | 2.01 | 0.07 | | |
| EXP1-4 | 43.96 | 0.75 | 0.35 | 0.05 | 1.80 | 0.11 | 44.31 | 1.12 |
| EXP1-5 | 49.71 | 1.12 | 0.41 | 0.03 | 2.37 | 0.05 | | |
| EXP1-5 | 47.76 | 0.59 | 0.31 | 0.04 | 1.78 | 0.13 | | |
| EXP1-5 | 47.36 | 1.90 | 0.36 | 0.04 | 1.98 | 0.16 | | |
| EXP1-5 | 46.04 | 0.76 | 0.31 | 0.03 | 1.72 | 0.24 | 47.72 | 1.52 |
| EXP1-6 | 42.93 | 0.07 | 0.29 | 0.05 | 1.67 | 0.13 | | |
| EXP1-6 | 46.07 | 0.93 | 0.22 | 0.05 | 1.50 | 0.13 | | |
| EXP1-6 | 47.46 | 0.94 | 0.38 | 0.04 | 2.30 | 0.09 | | |
| EXP1-6 | 47.63 | 1.05 | 0.29 | 0.02 | 1.81 | 0.11 | 46.02 | 2.18 |
| EXP1-7 | 41.48 | 1.12 | 0.30 | 0.05 | 1.74 | 0.04 | | |
| EXP1-7 | 46.06 | 0.75 | 0.33 | 0.03 | 2.08 | 0.18 | | |
| EXP1-7 | 43.10 | 1.41 | 0.32 | 0.02 | 1.87 | 0.05 | | |
| EXP1-7 | 45.11 | 1.16 | 0.30 | 0.01 | 1.76 | 0.12 | 43.94 | 2.05 |
| EXP1-8 | 50.24 | 0.40 | 0.35 | 0.04 | 2.39 | 0.07 | | |
| EXP1-8 | 44.05 | 1.17 | 0.28 | 0.06 | 1.72 | 0.16 | | |
| EXP1-8 | 50.30 | 0.34 | 0.40 | 0.03 | 2.47 | 0.08 | | |
| EXP1-8 | 43.23 | 1.20 | 0.27 | 0.02 | 1.65 | 0.07 | 46.96 | 3.84 |
| EXP1-9 | 43.98 | 0.42 | 0.27 | 0.02 | 1.51 | 0.06 | | |
| EXP1-9 | 47.31 | 1.06 | 0.35 | 0.02 | 1.90 | 0.19 | | |
| EXP1-9 | 44.25 | 0.96 | 0.25 | 0.01 | 1.52 | 0.14 | | |
| EXP1-9 | 45.03 | 0.79 | 0.31 | 0.04 | 1.84 | 0.14 | 45.14 | 1.51 |
| EXP1-10 | 37.82 | 0.38 | 0.27 | 0.02 | 1.29 | 0.14 | | |
| EXP1-10 | 41.16 | 0.83 | 0.37 | 0.06 | 2.07 | 0.15 | | |

TABLE 5-continued

| | | | | | | | | |
|---|---|---|---|---|---|---|---|---|
| EXP1-10 | 39.46 | 0.53 | 0.41 | 0.04 | 2.04 | 0.12 | | |
| EXP1-10 | 41.67 | 1.30 | 0.33 | 0.03 | 1.91 | 0.21 | 40.76 | 1.16 |
| EXP1-11 | 39.60 | 1.26 | 0.31 | 0.08 | 1.79 | 0.13 | | |
| EXP1-11 | 36.53 | 0.57 | 0.23 | 0.04 | 1.20 | 0.06 | | |
| EXP1-11 | 36.15 | 1.09 | 0.16 | 0.06 | 1.10 | 0.21 | | |
| EXP1-11 | 40.61 | 1.24 | 0.41 | 0.04 | 2.08 | 0.14 | 38.22 | 2.22 |
| EXP1-12 | 44.36 | 1.09 | 0.41 | 0.05 | 2.31 | 0.08 | | |
| EXP1-12 | 40.13 | 0.92 | 0.32 | 0.06 | 1.80 | 0.14 | | |
| EXP1-12 | 35.74 | 0.74 | 0.21 | 0.03 | 1.04 | 0.13 | | |
| EXP1-12 | 40.35 | 1.99 | 0.30 | 0.06 | 1.81 | 0.20 | 40.15 | 3.52 |
| EXP1-13 | 47.91 | 0.45 | 0.22 | 0.06 | 1.67 | 0.06 | | |
| EXP1-13 | 48.20 | 0.38 | 0.25 | 0.04 | 1.85 | 0.08 | | |
| EXP1-13 | 47.78 | 0.65 | 0.26 | 0.05 | 1.82 | 0.11 | | |
| EXP1-13 | 46.14 | 0.65 | 0.22 | 0.04 | 1.43 | 0.11 | 47.51 | 0.93 |
| EXP1-14 | 44.14 | 0.59 | 0.34 | 0.03 | 2.04 | 0.11 | | |
| EXP1-14 | 43.17 | 1.02 | 0.33 | 0.02 | 1.91 | 0.15 | | |
| EXP1-14 | 40.55 | 0.88 | 0.32 | 0.03 | 1.79 | 0.11 | | |
| EXP1-14 | 40.89 | 1.82 | 0.34 | 0.06 | 1.64 | 0.16 | 42.19 | 1.75 |

The data presented in Table 5 and FIG. 1 shows that experiments 2 and 4-9 provide better cleaning than the Commercial Products A-C (shown as experiments 10-12) and provide comparable or equal performance to Commercial Products D (shown as experiment 13). These results demonstrate that superior cleaning is achieved in comparison to commercially-available neutral cleaning compositions and at least the same cleaning as non-neutral (alkaline product D) products.

concentrated neutral cleaning composition. A passing evaluation was recorded for uniform appearance without separation, cloudy discoloration. A failing evaluation was recorded for any cloudy appearance and/or separation.

TABLE 6

| Concentrate ID | Hydrotrope | % by wt. Hydrotrope Post Added | Pass/Fail | Observations |
|---|---|---|---|---|
| C10 | SXS (96%) | 5% | Fail | Separation |
| C11 | SXS (96%) | 6% | Fail | Separation |
| C12 | SXS (96%) | 6.25% | Fail | Separation |
| C13 | SXS (96%) | 6.50% | Fail | Separation |
| C14 | SXS (96%) | 6.75% | Fail | Separation |
| C15 | SXS (96%) | 7% | Pass | Good, uniform appearance |
| C16 | SXS (96%) | 8% | Pass | Good, uniform appearance |
| C17 | Colatrope INC | 5% | Fail | Separation |
| C18 | Colatrope INC | 6% | Fail | Separation |
| C19 | Colatrope INC | 7% | Fail | Cloudy |
| C20 | Colatrope INC | 7.25% | Fail | Cloudy |
| C21 | Colatrope INC | 7.50% | Fail | Cloudy |
| C22 | Colatrope INC | 7.75% | Pass | Good, uniform appearance |
| C23 | Colatrope INC | 8% | Pass | Good, uniform appearance |

Table 7 shows the concentrates C10-C23 formulations expressed in % by wt. for the formulations.

TABLE 7

| Raw Material | expressed in % by wt. | | | | | | |
|---|---|---|---|---|---|---|---|
| Description | C10 | C11 | C12 | C13 | C14 | C15 | C16 |
| Water | 77.14% | 76.42% | 76.24% | 76.06% | 75.88% | 75.70% | 75.00% |
| Lutensol XP50 | 3.81% | 3.77% | 3.76% | 3.76% | 3.75% | 3.74% | 3.70% |
| Pluronic N3 | 14.29% | 14.15% | 14.12% | 14.08% | 14.05% | 14.02% | 13.89% |
| SXS (96%) | 4.76% | 5.66% | 5.88% | 6.10% | 6.32% | 6.54% | 7.41% |
| Colatrope INC | 0.00% | 0.00% | 0.00% | 0.00% | 0.00% | 0.00% | 0.00% |
| **Raw Material** | **expressed in % by wt.** | | | | | | |
| **Description** | **C17** | **C18** | **C19** | **C20** | **C21** | **C22** | **C23** |
| Water | 77.14% | 76.42% | 75.70% | 75.52% | 75.35% | 75.17% | 75.00% |
| Lutensol XP50 | 3.81% | 3.77% | 3.74% | 3.73% | 3.72% | 3.71% | 3.70% |
| Pluronic N3 | 14.29% | 14.15% | 14.02% | 13.99% | 13.95% | 13.92% | 13.89% |
| SXS (96%) | 0.00% | 0.00% | 0.00% | 0.00% | 0.00% | 0.00% | 0.00% |
| Colatrope INC | 4.76% | 5.66% | 6.54% | 6.76% | 6.98% | 7.19% | 7.41% |

Example 3

Improved stability of the concentrated formulations of Example 2 was further analyzed. The objective was to evaluate the addition of two different stabilizing agents to concentrate formulation #5 from Example 2 to provide stability (no separation) at high temperatures (50° C., oven).

Procedure: hydrotropes SXS (96%) and Colatrope INC were added to premade concentrate #5 (from Example 2). Concentrates were agitated until a uniform appearance was achieved and then allowed to equilibrate in a 50° C. oven for 2 hours. After two hours the samples were removed from the oven and observations of appearance were recorded. Table 6 shows the percentage by wt. of hydrotrope post-added to the The results show that the addition of SXS (96%) at 6.54% by wt and Colatrope INC at 7.19% by wt. provided stability (uniform and clear appearance) when exposed to 50° C. oven temperatures. A prolonged 4 week oven stability test was later carried out further showing good stability.

Example 4

The cleaning ability of neutral cleaning compositions according to the invention was evaluated. Formulation C5 (from Example 1) containing hydrotropes added for the purpose of stability was evaluated. Concentrate formulations C15 and C23 from Example 3 were further evaluated. Table 8 shows the use solution preparation for the experiment.

TABLE 8

| Experimental Test ID | Concentrate ID | Target Dilution | g Conc. | g Water | % by wt. Concentrate |
|---|---|---|---|---|---|
| EXP3-15 | C5 | 0.25 oz/gal | 0.98 | 499.05 | 0.20% |
| EXP3-16 | C15 | 0.25 oz/gal | 0.98 | 499.05 | 0.20% |
| EXP3-17 | C23 | 0.25 oz/gal | 0.99 | 499.05 | 0.20% |
| EXP3-18 | Commercial Product A | 0.5 oz/gal | 1.95 | 498.08 | 0.39% |
| EXP3-19 | Commercial Product D | 0.5 oz/gal | 1.95 | 498.03 | 0.39% |

The soil application procedure set forth in Example 2 was employed. The cleaning procedure set forth in Example 2 was also employed with one modification—a total of two tiles were tested for EXP3-15. The same data analysis procedure of Example 2 was utilized. The average L value of the 10 soiled coupons was 27.30 with a standard deviation of 0.39. Table 9 and FIG. 2 further show the after clean color data obtained.

TABLE 9

| Condition | L | St. Dev | a | St. Dev | b | St. Dev | Avg L | St. Dev |
|---|---|---|---|---|---|---|---|---|
| EXP3-15 | 49.07 | 0.67 | 0.42 | 0.03 | 2.57 | 0.08 | 49.560 | 0.693 |
| EXP3-15 | 50.05 | 0.79 | 0.41 | 0.08 | 2.51 | 0.07 | | |
| EXP3-16 | 46.83 | 0.82 | 0.39 | 0.04 | 2.15 | 0.04 | 46.515 | 0.909 |
| EXP3-16 | 46.31 | 0.86 | 0.43 | 0.05 | 2.09 | 0.11 | | |
| EXP3-16 | 47.54 | 1.01 | 0.50 | 0.05 | 2.92 | 0.17 | | |
| EXP3-16 | 45.38 | 0.95 | 0.35 | 0.07 | 2.04 | 0.24 | | |
| EXP3-17 | 49.02 | 1.16 | 0.40 | 0.05 | 2.51 | 0.13 | 47.423 | 1.549 |
| EXP3-17 | 48.39 | 1.49 | 0.35 | 0.04 | 2.22 | 0.06 | | |
| EXP3-17 | 46.60 | 0.87 | 0.43 | 0.03 | 2.43 | 0.11 | | |
| EXP3-17 | 45.68 | 1.06 | 0.36 | 0.05 | 2.18 | 0.07 | | |
| EXP3-18 | 37.92 | 1.34 | 0.32 | 0.03 | 1.61 | 0.11 | 36.970 | 2.302 |
| EXP3-18 | 37.36 | 1.87 | 0.36 | 0.06 | 1.74 | 0.17 | | |
| EXP3-18 | 38.94 | 0.43 | 0.28 | 0.84 | 1.56 | 0.06 | | |
| EXP3-18 | 33.66 | 0.42 | 0.33 | 0.07 | 1.68 | 0.07 | | |
| EXP3-19 | 50.23 | 0.35 | 0.36 | 0.02 | 2.28 | 0.11 | 50.268 | 0.343 |
| EXP3-19 | 50.47 | 0.49 | 0.38 | 0.03 | 2.51 | 0.11 | | |
| EXP3-19 | 50.57 | 0.42 | 0.37 | 0.03 | 2.41 | 0.11 | | |
| EXP3-19 | 49.80 | 0.51 | 0.37 | 0.07 | 2.08 | 0.14 | | |

Figure 2:
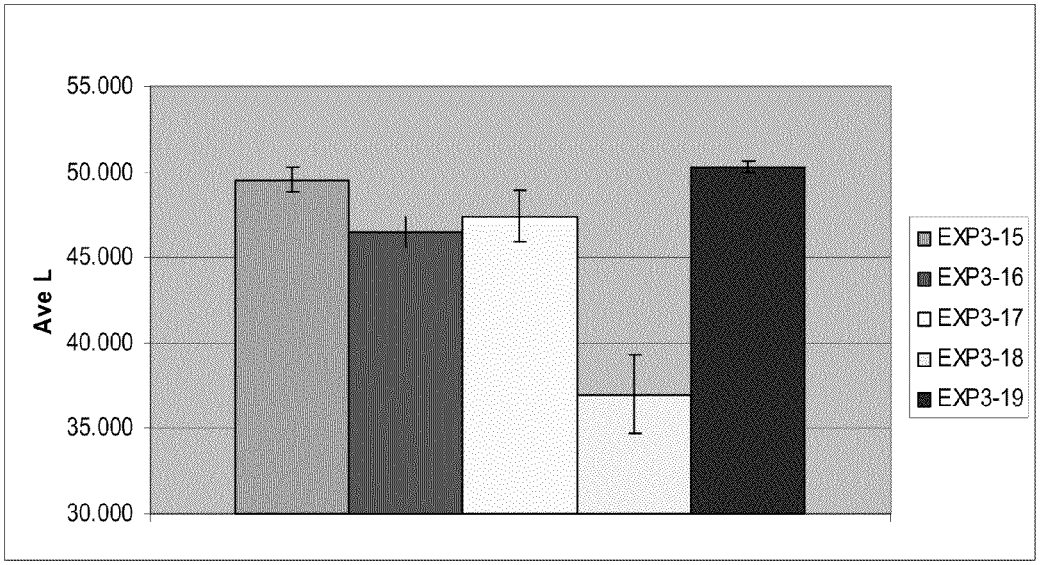
FIG. 2 shows a comparison of cleaning efficacy of neutral cleaning compositions according to the invention (Exp3-15, Exp3-16, Exp3-17) in comparison to commercially-available controls (positive (Exp3-19) and negative controls (Exp3-18).

Table 9 and FIG. 2 demonstrate experimental conditions 15-17 (Exp3-15, Exp3-16, Exp3-17) according to the neutral cleaning composition of the invention provide efficacious cleaning at a neutral pH. In particular, conditions 16 and 17 had very similar cleaning performance to condition 15. Condition 15 (Exp3-15) had very comparable/equal cleaning performance to condition 19 (Exp3-19, Commercial Product D, daily alkaline cleaner serving as positive control according to the invention). The data further demonstrate the addition of a stabilizing agent provides a formulation with equivalent cleaning performance to current commercial daily alkaline cleaners which has significantly better cleaning performance than current commercial daily neutral cleaners (Exp3-18, condition 18).

Example 5

Neutral cleaning compositions were further evaluated for formulation modifications to eliminate the need for using glove and goggles when handling the concentrate (e.g. personal protective equipment (PPE)). Formulations having minimized surfactant concentrations to meet regulatory standards (e.g. GHS) for elimination of PPE were evaluated. The cleaning efficacy was evaluated for various formulations containing a reduced level of a water-insoluble Guerbet ethoxylate surfactant. Table 10 shows the various concentrate formulations. Table 11 shows the various use solution preparations.

TABLE 10

| Raw Material | expressed in % by wt | | | |
|---|---|---|---|---|
| Description | C24 | C25 | C26 | C27 |
| DI Water | 61.94% | 63.03% | 61.94% | 67.66% |
| Lutensol XP50 | 3.99% | 2.90% | 2.90% | 2.90% |
| Pluronic N3 | 16.96% | 16.96% | 18.05% | 12.33% |
| SXS (40%) | 16.80% | 16.80% | 16.80% | 16.80% |
| Dye | 0.01% | 0.01% | 0.01% | 0.01% |
| Fragrance | 0.25% | 0.25% | 0.25% | 0.25% |
| Preservative | 0.05% | 0.05% | 0.05% | 0.05% |

TABLE 11

| Experimental Test ID | Concentrate | Target Dilution | Cleaner (g) | Water (g) | % Concentrate |
|---|---|---|---|---|---|
| EXP4-20 | C24 | 0.25 oz/gal | 0.98 | 499.02 | 0.20% |
| EXP4-21 | C25 | 0.25 oz/gal | 0.99 | 499.03 | 0.20% |
| EXP4-22 | C26 | 0.25 oz/gal | 0.98 | 499.02 | 0.20% |
| EXP4-23 | C27 | 0.25 oz/gal | 0.99 | 499.01 | 0.20% |
| EXP4-24 | Commercial Product A | 0.50 oz/gal | 0.98 | 249.01 | 0.39% |
| EXP4-25 | Commercial Product D | 0.50 oz/gal | 0.97 | 249.01 | 0.39% |

The soil application procedure set forth in Example 2 was employed. The cleaning procedure set forth in Example 2 was also employed with a modification—a total of two tiles were tested for EXP4-24 and EXP4-25. The same data analysis procedure of Example 2 was utilized. After soiling the coupons, they had very similar color values. One set of five coupons had an L value of 28.24+/−0.43 and a second set of five coupons had an L value of 28.10+/−0.42. The after clean color data is shown in FIG. 3.

Figure 3:
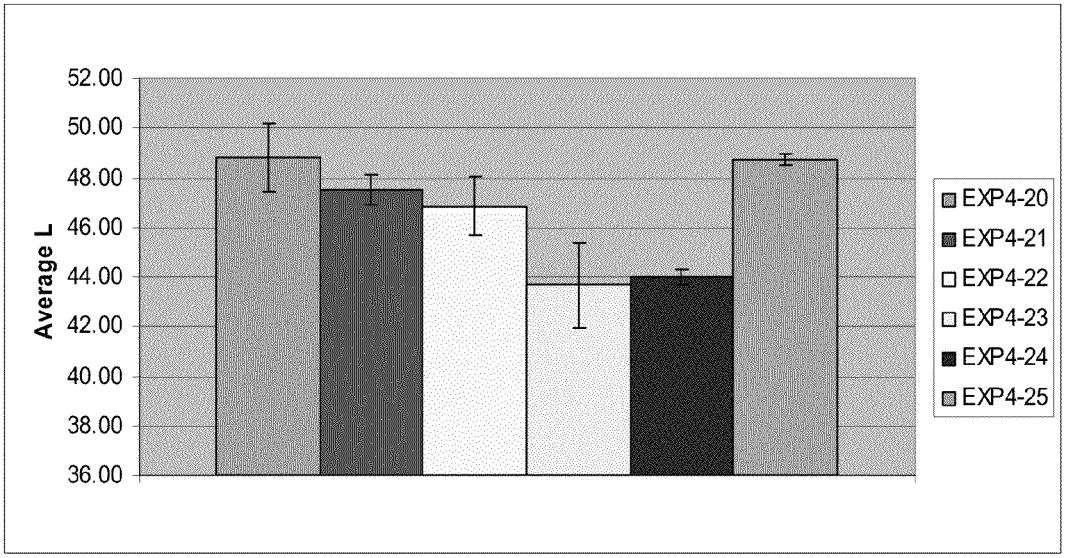
FIG. 3 shows a comparison of cleaning efficacy of neutral cleaning compositions according to the invention (Exp4-20, Exp4-21, Exp4-22) in comparison to commercially-available controls (positive (Exp4-25) and negative controls (Exp4-24)).

Reduction (or elimination) of the PPE requirements of the concentrate formulations of the neutral cleaning compositions of the invention may be achieved as shown in FIG. 3 and this Example 5. Experimental conditions 21 and 22 provide similar cleaning to condition 20 which provides similar cleaning to the commercially-available daily alkaline floor cleaner products (positive control, condition 25).

Example 6

The neutral cleaning compositions described according to the invention demonstrate hard surface cleaning efficacy for various conditions and markets. Various concentrations of the formulated neutral cleaning compositions were evaluated. Less concentrated formulations may include those dispensed at 0.5 oz/gal and 2.0 oz/gal. A 0.5 oz/gal dispensed formulation was formulated using a one half of a concentrated formulation of Example 5 (0.25 oz/gal dispensed formulation) as shown in Table 12. Additional less concentrated formulations may be employed, including for example a 2.0 oz/gal formulation.

TABLE 12

| RM | Description | % by wt. |
|---|---|---|
| 100032 | Water Deionized TNK | 80.815 |
| 170591 | Lutensol XP50 | 1.995 |
| 170322 | Pluronic N3 | 8.48 |
| 171371 | SXS (40%) | 8.4 |
| 300756 | Preservative | 0.05 |
| 260142 | Fragrance | 0.25 |
| 271205 | Dye | 0.01 |

Example 7

The foam profile of the compositions of the invention was evaluated. In particular, the objective of the trial was to evaluate the foam profile of use solutions of Concentrate 24 in comparison to Commercial Product A.

Use Solution Preparation: A 0.25 oz/gal solution was prepared (0.20% solution of concentrate 24) along with a 0.5 oz/gal solution (0.39% solution of Commercial Product A).

Foam Test Procedure: 20 mL of each test solution described above (See Use Solution Preparation) was added to a 200 mL graduated cylinder. The graduated cylinders were sealed. An individual held one cylinder in each hand, using the same motion and force, and inverted the cylinders upside down and back to original position for a total of 10 times. Immediately after the 10 inversions, the foam height of each cylinder was recorded according to the mL markings on the cylinders. Again, after 3 minutes the foam height in each cylinder was recorded using the mL markings on the cylinders. A higher value (according to the mL markings on the cylinders) indicates more foam generation/presence.

Results: Based on this experiment the 0.25 oz/gal use solution of concentrate 24 generated nearly zero foam. Results are shown in Table 13 where the initial level of foam generated by concentrate 24 is less than 1 marking on the cylinder, which is distinct from Commercial Product A generating a significant amount of foam measured by at least 18 markings on the cylinder. After 3 minutes the foam level of concentrate 24 returned to baseline, whereas the foam level of Commercial Product A remained significantly above the baseline. The composition of the present invention demonstrates clear benefits of providing a low-foam or no-foam profile.

TABLE 13

| Measurement Period | Commercial Product A | 0.25 oz/gal Concentrate 24 |
|---|---|---|
| solution level | 20 | 20 |
| After 10 Inversions | 38 | <21 |
| After 3 minutes | 26 | 20 |

The inventions being thus described, it will be obvious that the same may be varied in many ways. Such variations are not to be regarded as a departure from the spirit and scope of the inventions and all such modifications are intended to be included within the scope of the following claims.

What is claimed is:

1. A concentrated neutral floor treatment composition comprising:

about 1-50 wt-% of at least two water-insoluble surfactants, wherein a first surfactant is a branched alcohol alkoxylate and a second surfactant comprises a reverse ethylene oxide/propylene oxide copolymer; and about 1-50 wt-% of a water-soluble anionic hydrotrope; and about 20-90 wt-% water, wherein the composition has a from about 6 to 9 and forms a clear solution.

2. The composition according to claim 1, wherein the branched alcohol alkoxylate is a Guerbet ethoxylate having the formula $$CH_3(CH_2)_n\underset{\underset{R^1}{|}}{C}HCH_2O(CH_2\underset{\underset{R^2}{|}}{C}HO)_mH$$

wherein $R^1$ is a C2-C20 alkyl, $R^2$ is a H or C1-C4 alkyl, n is 2-20 and m is 1-40.

3. The composition according to claim 1, wherein the second surfactant further comprises a EO-PO copolymer.

4. The composition according to claim 2, wherein the water-insoluble Guerbet ethoxylate is about 30 wt-% to about 60 wt-% ethylene oxide, and wherein the anionic hydrotrope is selected from the group consisting of xylene sulfonate and its salts, cumene sulfonate and its salts, and a C6-C10 fatty acid and its salts.

5. The composition of claim 1, wherein the weight ratio of said second surfactant to said first surfactant are from about 2:1 to about 20:1, wherein the weight ratio of said first surfactant to said hydrotrope are from about 1:20 to about 5:1, and wherein the weight ratio of said second surfactant to said hydrotrope are from about 1:10 to about 10:1.

6. A concentrated neutral floor treatment composition comprising:

about 1-10 wt-% of a water-insoluble Guerbet ethoxylate having the following formula;

$$CH_3(CH_2)_n\underset{\underset{R^1}{|}}{C}HCH_2O(CH_2\underset{\underset{R^2}{|}}{C}HO)_mH$$

about 1-50 wt-% of a water-insoluble reverse EO-PO copolymer;

about 1-50 wt-% of a water-soluble anionic hydrotrope; and about 20-90 wt-%, water, wherein the composition has a pH from about 6 to 9 and forms a clear solution.

7. The composition according to claim 6, wherein $R^1$ is a C2-C20 alkyl, $R^2$ is a H or C1-C4 alkyl, n is 2-20, and m is 1-40, and wherein the Guerbet ethoxylate is prepared from a Guerbet alcohol by dimerization of an alkene.

8. The composition according to claim 6, wherein the water-insoluble Guerbet ethoxylate is about 30 wt-% to about 60 wt-% ethylene oxide, and wherein the reverse EO-PO copolymer has a molecular weight less than about 10,000.

9. The composition according to claim 6, wherein the compositions retains phase stability at elevated temperatures of up to about 50° C.

10. The composition according to claim 6, wherein the water-insoluble Guerbet ethoxylate is about 30 wt-% to about 60 wt-% ethylene oxide, and wherein the anionic hydrotrope is selected from the group consisting of xylene sulfonate and its salts, cumene sulfonate and its salts, and a C6-C10 fatty acid and its salts.

11. The composition according to claim 6, wherein the weight ratio of said reverse EO-PO copolymer surfactant to said water-insoluble Guerbet ethoxylate surfactant is from about 2:1 to about 20:1, wherein the weight ratio of said water-insoluble Guerbet ethoxylate surfactant to said anionic hydrotrope are from about 1:20 to about 5:1, and wherein the weight ratio of said EO-PO reverse copolymer surfactant to said anionic hydrotrope are from about 1:10 to about 10:1.

12. The composition according to claim 6, wherein the composition does not contain any agents selected from the group consisting of a builder, chelant, sequestrant, threshold agent/inhibitor and combinations thereof.

13. The composition according to claim 6, wherein the composition does not include a viscosity modifier and/or organic solvent.

14. A kit comprising:

a liquid detergent composition, wherein said composition is the neutral cleaning composition according to claim 6;

a container; and instructions for use of the kit.

15. The kit of claim 14, further comprising a removal agent for use in applying the neutral cleaning compositions and removing a plurality of soils.

16. A method for cleaning a hard surface comprising: applying to the hard surface a neutral cleaning composition comprising about 1-10 wt-% water-insoluble Guerbet ethoxylate surfactant having the following formula

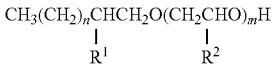

$$CH_3(CH_2)_nCHCH_2O(CH_2CHO)_mH$$
$$\quad\quad\quad\quad | \quad\quad\quad\quad\quad\quad | \quad\quad\quad\quad$$
$$\quad\quad\quad\quad R^1 \quad\quad\quad\quad\quad\quad R^2 \quad\quad\quad\quad$$

about 1-50 wt-% of a water-insoluble reverse EO-PO copolymer surfactant, about 1-50 wt-% of a water-soluble anionic hydrotrope and about 20-90 wt-% of water, wherein the composition has a pH from about 6 to 9 and forms a clear solution.

17. The method according to claim 16, further comprising a step of diluting the composition into a use solution with water before applying the composition to a hard surface, and wherein the dilution provides a dispensing rate of a use solution of the neutral cleaning composition from about 0.1 oz./gal to about 10 oz./gal.

18. The method according to claim 16, wherein the neutral cleaning composition provides at least equivalent cleaning efficacy in comparison to alkaline cleaning solutions.

19. The method according to claim 16, wherein the neutral cleaning composition does not require use of personal protective equipment by an end-user.

20. The method of claim 16, further comprising removing soil from the hard surface using a removal agent selected from the group consisting of a mop, auto scrubber, spray dispenser, compressed air and combinations thereof.

21. A composition according to claim 1, wherein the weight ratio of said second surfactant to said hydrotrope is about 1:1, and wherein the weight ratio of said first surfactant to said hydrotrope is from about 1:1.

22. The composition according to claim 1, wherein the weight ratio of said second surfactant to said first surfactant to said hydrotrope is about 1:1:1.

23. The composition according to claim 6, wherein the weight ratio of said Guerbet ethoxylate to said water soluble anionic hydrotrope is about 1:1, and wherein the weight ratio of said reverse EO-PO copolymer to said water soluble anionic hydrotrope is about 1:1.

24. The composition according to claim 6, wherein the weight ratio of said reverse EO-PO copolymer surfactant to said water insoluble Guerbet ethoxylate surfactant to said anionic hydrotrope is about 1:1:1.

25. The method according to claim 16, wherein the weight ratio of reverse EO-PO copolymer surfactant to said water insoluble Guerbet ethoxylate surfactant to said anionic hydrotrope is about 1:1:1.

* * * * *